US005101729A

United States Patent [19]

Noble et al.

[11] Patent Number: 5,101,729

[45] Date of Patent: Apr. 7, 1992

[54] LOW ENERGY FUSE

[75] Inventors: Alan H. Noble; David P. Sutton, both of Ayr, Scotland

[73] Assignee: Imperial Chemical Industries PLC, London, England

[21] Appl. No.: 669,434

[22] Filed: Mar. 15, 1991

[30] Foreign Application Priority Data

Mar. 15, 1990 [GB] United Kingdom ..... 9005841
Dec. 17, 1990 [GB] United Kingdom ..... 9027242

[51] Int. Cl.[5] ..... C06C 5/04

[52] U.S. Cl. ..... 102/275.8; 102/275.1; 149/3; 149/4; 149/35; 149/62; 149/69; 149/76; 149/80; 149/88; 149/92; 149/93; 149/105

[58] Field of Search ..... 149/92, 93, 105, 88, 149/3, 4, 62, 69, 78, 80, 35; 102/275.8, 275.1

[56] References Cited

U.S. PATENT DOCUMENTS 4,660,474 4/1987 Dias dos Santos ..... 102/275.8
4,756,250 7/1988 Dias dos Santos ..... 102/275.1
4,838,165 6/1989 Gladden et al. ..... 102/275.8

*Primary Examiner*—Stephen J. Lechert, Jr.
*Attorney, Agent, or Firm*—Cushman, Darby & Cushman

[57] ABSTRACT

In a low energy fuse, the reactive composition on the inner wall of the tubing is substantially free of a metal fuel or quasi metal fuel and comprises a particulate secondary high explosive and a gas generating non-explosive particulate solid selected from barium peroxide, barium nitrate, potassium permanganate, potassium chloride or sodium azide. The gas generating solid renders the fuse safer for use in an inflammable or incendive atmosphere such as a coal mine.

7 Claims, No Drawings

LOW ENERGY FUSE

FIELD OF INVENTION

This invention relates to a low energy fuse of the type comprising tubing having a coating of reactive composition (usually a shock-dislodgable unconsolidated mixture of particles) on the inner wall thereof for propagating a shock wave along the tube.

DESCRIPTION OF PRIOR ART

Low energy fuses or 'shock wave conductors' coupled to instantaneous or delay detonators are well known in the field of blasting and are popular alternatives to electric detonator systems. In use, the free end of the tubing of the fuse is attached to an initiator which might be an electric discharge device or another primary detonator. When the initiator is fired, a shock wave is transmitted along the tubing driven by the rapid chemical reaction and detonation of the reactive material coating on the inner surface thereof.

Typical examples of low energy fuses of the type aforesaid are described inter alia in the following patents: U.S. Pat. Nos. 3,590,739, 4,290,366, 4,607,573, 4,660,474, GB 2,027,176 and GB 2,152,643. A low energy fuse of the type is also available commercially under the trade mark 'Nonel'. A number of reactive compositions can be used within the low energy fuse tubing, for example in U.S. Pat. No. 3,590,739 there is suggested PETN, RDX, HMX, TNT, dinitroethylurea, or tetryl, and in U.S. Pat. No. 4,660,474 aluminium and potassium dichromate are disclosed.

Although these known low energy fuses are suitable for blasting in an open environment, they are not suitable for use in inflammable atmospheres such as found in coal mines. On the contrary only explosives and accessories which have passed a strict series of safety tests (the standards of which vary from country to country) can be entered on a list of 'permitted items' for use in mines and other inflammable atmospheres.

It is an object of the present invention to provide a low energy fuse which is safer for use in an inflammable or incendive atmosphere.

It is a further object of the invention to provide a low energy fuse which will qualify for use in incendive or inflammable atmospheres to the satisfaction of the regulatory mining authorities.

SUMMARY OF THE INVENTION

According to a first aspect of the invention there is provided a low energy fuse comprising tubing having a coating of a reactive composition on the inner wall thereof for propagating a shock wave along the tubing, the reactive coating being substantially free of a metal or quasi metal fuel and including a particulate secondary high explosive and a gas generating non-explosive particulate solid in intimate admixture therewith, the gas generating solid being a material that decomposes thermally at a temperature below 1000° C. and 1 atmosphere pressure.

A further aspect of the invention comprises the use of a gas generating non-explosive particulate solid as disclosed herein in intimate admixture with a particulate secondary high explosive as a coating on the inner wall of a low energy shock tube to render safer the fuse for use in an inflammable or incendive atmosphere. Also provided is:

A method of lowering the incendivity of a low energy fuse having a tubing, the method comprising forming on the inner wall of the tubing a reactive coating being substantially free of a metal or quasi metal fuel and including a particulate secondary high explosive in intimate admixture therewith, the gas generating solid being a material that decomposes thermally at a temperature below 1000° C. and 1 atmosphere pressure.

The propagating reaction of a low energy fuse can be controlled by using said gas generating solid. Its presence may lower the VOD of the reaction (relative to that when secondary high explosive alone is used) and may significantly lower the sensible thermal energy released by the reaction. As a result the low energy fuse is safer to use in inflammable atmospheres and suitably formulated can meet the standards of the current permitted electric detonator tests set by the UK authorities when fired with the fuse end open to the test incendive atmosphere.

It is not known how the gas generating solid achieves the desired effect, but its presence is essential. Early research shows that most encouraging results are obtained by oxygen-generating solids, preferably a metal oxide, nitrate, peroxide, permanganate or perchlorate—particularly of alkali metals and alkaline earth metals. Support for these propositions are found in our results for barium peroxide, barium nitrate, potassium permanganate and potassium perchlorate, which have been proved to be very satisfactory. It has also been shown, however, that non oxygen generating solids such as sodium azide (which releases nitrogen) are also suitable.

The particle size of the gas generating solid can vary within fairly wide limits but its upper limit is generally constrained by the process of depositing it within the tube and therefore will generally be below 60 microns. For the secondary high explosive, particle sizes of about 10 to 40 microns, typically as found in conventional low energy fuses, are suitable.

By the term secondary high explosive we mean molecular explosives which will generally require a primary charge to detonate them and typical examples are pentraerythritoltetranitrate (PETN), cyclotrimethylene-tritetryl (RDX), cyclotetramethylenetetranitramine (HMX), tetryl, trinitrotoluene (TNT), dinitroethyl urea, or mixtures of these compounds. It will be noted that these explosives are either oxygen balanced or at least not critically oxygen deficient.

Typically a VOD in the shock tube of below $1800ms^{-1}$, preferably below $1600ms^{-1}$ is advantageous. A significant presence of a metal or quasi metal in the system with the air or released oxygen in the tube is undesirable for use in an inflammable atmosphere, not least because of the high thermal energy that would be generated and the formation of sintered agglomerates of high temperature and heat capacity. Very desirably reactive metals or quasi metals (e.g. Al or Si or Sb) are totally absent.

Although the molar ratio of the secondary high explosive to gas generating solid can be within fairly wide limits, it should generally be within the range of from about 9:2 to about 1:3. A ratio of 3:2 is used in the examples hereinafter.

The core loading of the reactive coating can again be variable, being limited to about $15mgm^{-1}$ at its lower end for acceptable and reliable shock propagation and about $40mgm^{-1}$ at its upper end to prevent the tube splitting.

The reactive coating must be able to propagate along the full length of the fuse tubing and adhere sufficiently to its inner surface so as to avoid long discontinuities forming during normal handling. Reference should be made to the aforementioned US and UK patents such as for different methods of achieving adherence of the reactive coating, for manufacture of the tubing, and for locating the reactive coating within the tubing.

The examples of low energy fuses described hereinafter are evaluated with regard to the electric detonator permitted tests of the United Kingdom authorities, being the closest relevant reference standard.

The practical conditions under which explosives ignite a flammable atmosphere such as coal dust or a methane/air mixture are difficult to establish with any degree of certainty and the normal way of assessing the safety of an explosive or detonator intended for use in a coal mine is by a series of gallery tests. Details of UK gallery tests are contained in Testing Memoranda published by the Health and Safety Executive, Buxton.

The fuses of the following examples were introduced into the tubular receivers of the test gallery as if the main tube length were a pair of electric leads and the end portion of the inserted length of tube were an electric detonator. The end of the tube is open to the gallery incendive atmosphere and the open tube end was positioned at the point where the base charge of an electric detonator would be situated. The testing of an open tube not coupled with a detonator is a "worst case" testing as if the tube were to be pulled from the detonator or burst along its length.

DESCRIPTION OF PREFERRED EMBODIMENTS

The invention will now be described by way of illustration only, with reference to the accompanying examples.

EXAMPLE 1

A low energy fuse was produced by adding a mixture of HMX (particle size about 10 to 40 microns) and $BaO_2$ (particle size less than 60 microns) in a weight ratio of 3:2, in a manner known per se in the art, to the inner surface of a 1.5 mm I.D. tubing made of Surlyn (a trade mark of Du Pont). The core load per linear meter was about 30 mg (but this could vary for the present examples between about 15 to 40 mgm) and the tube length was typically about 5 meters.

In one hundred successful firings no ignitions of the incendive atmosphere occurred.

EXAMPLES 2 TO 8

Further examples were carried out using various materials as shown in table 1. The results of the firings are summarized in this table (including that of example 1). The tubes were loaded with mixed powders by either aspiration of the pre-formed tube or powder introduction during tube melt extrusion and consolidation.

| LOW ENERGY FUSE COMPOSITION | RATIO OF COMPOSITION | FIRINGS | IGNITIONS | IGNITION RATE % |
|---|---|---|---|---|
| HMX/$BaO_2$ | 3:2 | 4 | 0 | 0% |
| HMX/$KClO_4$ | 3:2 | 23 | 0 | 0% |
| HMX/$NaN_3$ | 3:2 | 19 | 0 | 0% (VOD = 1650 $ms^{-1}$ |
| HMX/$KMnO_4$ | 3:2 | 15 | 1 | 7% |
| HMX/$Ba(NO_3)_2$ | 3:2 | 16 | 1 | 6% |
| Si/$BaO_2$ (X) | 1:3 | 12 | 6 | 50% |
| HMX (X) | — | 12 | 4 | 33% |
| ALUMINUM, FUEL AND HMX (X) | 6:94 | several | — | >50% |

X = comparative examples where there is a metal/quasi metal fuel present and/or no gas-generant.
Examples 1-5: VOD < 1800 $ms^{-1}$ The results show that the addition of gas generating solids to the secondary high explosive, typically metal oxides and azides, with low to intermediate decomposition temperatures (<1000° C. at 1 atmosphere) lowers the incendivity of the resultant fuse in the absence of metal/quasi metal fuels.

It will be appreciated that although the examples reference permitted tests of the UK authorities, the invention is not restricted to fuses meeting any specific non-incendive criteria but rather generally provides a low energy fuse which is safer to use than prior art fuses in an inflammable or incendive atmosphere.

It should also be noted that the present invention is applicable to most situations where normal shock tubes or low energy tubes could be used, and particular advantages of the invention are improved static resistance, and lower incendivity.

What is claimed:

1. A low energy fuse comprising tubing having a coating of a reactive composition on the inner wall thereof for propagating a shock wave along the tubing, the reactive coating being substantially free of a metal or quasi metal fuel and including a particulate secondary high explosive and a gas generating non-explosive particulate solid in intimate admixture therewith, the gas generating solid being a material that decomposes thermally at a temperature below 1000° C. and 1 atmosphere pressure.

2. A low energy fuse as claimed in claim 1 wherein the gas generating solid is selected from the group consisting of an oxygen-generating solid, and a nitrogen-generating solid.

3. A low energy fuse as claimed in claim 2 wherein the oxygen-generating solid is selected from the group consisting of a metal oxide, metal nitrate, metal peroxide, metal permagnanate, and a metal perchlorate; and the nitrogen-generating solid is a metal azide.

4. A low energy fuse as claimed in claim 3 wherein the metal of the gas generating solid is selected from the group consisting of an alkali metal and an alkaline earth metal.

5. A low energy fuse as claimed in claim 4 wherein the gas generating solid is selected from the group consisting of barium peroxide, barium nitrate, potassium permanganate, potassium perchlorate, and sodium azide.

6. A low energy fuse as claimed in claim 1 wherein the ratio of the secondary high explosive to gas generating solid is 9:2 to 1:3.

7. A method of lowering the incendivity of a low energy fuse having a tubing, the method comprising forming on the inner wall of the tubing a reactive coating being substantially free of a metal or quasi metal fuel and including a particulate secondary high explosive and, in intimate admixture therewith, a gas generating solid being a material that decomposes thermally at a temperature below 1000° C. and 1 atmosphere pressure.

* * * * *